US006434356B1

(12) United States Patent
Ishijima et al.

(10) Patent No.: US 6,434,356 B1
(45) Date of Patent: Aug. 13, 2002

(54) RECORDING APPARATUS RESPONSIVE TO CHANGING ELECTRICAL RESISTANCE OF TRANSFER MEDIA

(75) Inventors: Hiroyasu Ishijima; Kunihiko Sato; Hideki Kamaji; Hisashi Hanzawa, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/658,155

(22) Filed: Sep. 8, 2000

(30) Foreign Application Priority Data

Oct. 27, 1999 (JP) ..... 11-304956

(51) Int. Cl.[7] ..... G03G 15/16
(52) U.S. Cl. ..... 399/313; 399/310
(58) Field of Search ..... 399/66, 297, 303, 399/310, 312, 313

(56) References Cited

U.S. PATENT DOCUMENTS 5,300,984 A * 4/1994 Fuma et al. ..... 399/66
5,331,383 A 7/1994 Nou et al.
5,495,317 A * 2/1996 Matsuda et al. ..... 399/66
5,515,146 A * 5/1996 Harasawa et al. ..... 399/310
6,002,905 A * 12/1999 Matsuda ..... 399/303
6,226,486 B1 * 5/2001 Itou et al. ..... 399/303

FOREIGN PATENT DOCUMENTS

| | | |
|---|---|---|
| JP | 05-11640 | 1/1993 |
| JP | 06-35344 | 2/1994 |
| JP | 09-34278 | 2/1997 |
| JP | 09-80937 | 3/1997 |
| JP | 10-207258 | 8/1998 |

* cited by examiner

*Primary Examiner*—Sandra Brase
(74) *Attorney, Agent, or Firm*—Armstrong, Westerman, & Hattori, LLP

(57) ABSTRACT

An image transferring apparatus is provided which holds a print sheet in a nip between an image carrier and a transfer roller and supplies the current to the transfer roller to transfer a toner image formed on the image carrier to the print medium. The apparatus has conductive brushes disposed in contact with ends. of the transfer roller to form a bypass circuit. The bypass circuit is connected to ground through a resistor and introduce the part of the current supplied to the transfer roller in an image transferring operation, thereby avoiding formation of any print defects such as discharge-caused marks or toner stops.

5 Claims, 5 Drawing Sheets

RECORDING APPARATUS RESPONSIVE TO CHANGING ELECTRICAL RESISTANCE OF TRANSFER MEDIA

BACKGROUND OF THE INVENTION

1. Technical Field of the Invention

The present invention relates generally to a recording apparatus such as a printer, a copying machine, or a facsimile machine which is designed to hold a transfer medium such as a printing sheet in a nip between an image carrier such as a photosensitive medium and a transfer member such as a transfer roller and apply a constant current to the transfer member to transfer visible images such as toner images formed on the image carrier to the transfer medium electrostatically.

2. Background Art

In recent years, as laser printers become increasingly more prevalent, there are increasing needs for compact structure and high-speed operation. Increased concerns about resources and environmental problems also require effective use of paper. From this point of view, printers are required to be capable of transferring images to both face and back of a print sheet. Further, with an increase in user convenience, there is an increasing need for printing images on various types of print mediums.

FIG. 6 shows one example of conventional printers.

The printer includes a brush electrifier 102, an exposure device 103, a developing device 104, a transfer device 105, a cleaner 106, a fixing device 107, a paper feeder 108, a paper ejector 109, and a reversing mechanism 110. The brush electrifier 102 has a rotary brush disposed in contact with a photosensitive drum 101 and rotates and applies the voltage to the rotary brush to electrify the photosensitive drum 101. The exposure device 103 activates a semiconductor laser in a given emission pattern to exposure the surface of the photosensitive drum 101 to laser beams to form an electrostatic latent image. The developing device 104 is of a non-magnetic component contact type and has disposed therein toner made of solid ink powder. The developing device 104 electrifies the toner and transport it to the surface of the photosensitive drum 101 to develop the electrostatic latent image. The transfer device 105 has a transfer roller 105 which forms a nip between itself and the photosensitive drum 101 through which transfer paper passes to transfer the toner image electrostatically. The cleaner 106 scrapes remaining toner off the photosensitive drum 101 after the image transferring operation. The fixing device 107 has a heat roller which fixes the toner image on the transfer paper with heat and pressure. The paper feeder 108 feeds the transfer paper to the transfer device 105. The paper ejector 109 ejects the transfer paper out of the fixing device 107. The reversing mechanism 110 turns over the transfer paper for transferring images on the back of the transfer paper.

In the image transferring operation, the photosensitive drum 101 is rotated at a given process speed. The brush electrifier 102 charges the surface of the photosensitive drum 101 at a black potential (several hundreds of minus volts).

Next, the semiconductor laser exposure device 103 is activated to emit light in a transfer pattern to form a desired latent image on the photosensitive drum 101. Specifically, charges are produced on laser-exposed portions of the photosensitive drum 101 so that the potential thereof drops to a level called a brightness potential, usually several tens of minus volts.

The toner charged negatively by the developing device 104 is applied on the photosensitive drum 101 through the developing roller to form a toner image. The developing roller made up of a stainless shaft covered with conductive rubber. The electrostatic transfer of the toner to the latent image to form the visible toner image is achieved by pressing the developing roller against the photosensitive drum 101 and applying several hundreds minus volts to the shaft of the developing roller to produce a strong electric field oriented to the latent image.

The photosensitive drum 101 and the transfer roller 105*a* of the transfer device 105 are, as described above, pressed on each other to form a nip (also referred to as a transfer nip below). The toner image moves to the transfer nip with rotation of the photosensitive drum 101. The transfer paper is transported from the paper feeder 108 to the transfer nip. A given current is supplied from a constant current source (not shown) to the transfer roller 105*a* to form the electric field between the transfer roller 105*a* and the photosensitive drum 101 so that the toner image is transferred electrostatically onto the transfer paper from the photosensitive drum 101.

The transfer roller 105*a* is made of a stainless shaft covered with a conductive foam such as a rubber resin) having a preselected surface-to-shaft resistance and a preselected hardness. Specifically, the transfer roller 105*a* is made of a flexible elastic member which has the preselected hardness at least on the surface thereof in order to increase an area of contact with the photosensitive drum 101. The transfer roller 105*a* is forced into constant engagement with the photosensitive drum 101.

The toner on the photosensitive drum 101 are charged negatively, therefore the polarity of the transfer current is positive. For instance, in a case where a print sheet of a certain size is transported in a lengthwise direction thereof to transfer a toner image thereto, the transfer current required for proper transfer is determined as a function of the process speed and the width of the print sheet and controlled constantly.

The toner remaining on the photosensitive drum 101 is removed by a urethane rubber-made cleaning blade installed in the cleaner 106 to clean the surface of the photosensitive drum 101 for the next operation.

The toner image on the print sheet is transported to the fixing device 107 and fixed by the heat and pressure. The print sheet is then ejected by the paper ejector 109.

Upon initiation of a back transfer mode of operation, the transfer paper is transported again to the transfer device 105 from the paper ejector 109 through the reversing mechanism 110. After an toner image is transferred onto the back of the transfer paper and fixed by the fixing device 107, the transfer paper is ejected by the paper ejector 109.

Such an image transferring apparatus using a transfer member like the transfer roller 105*a* has a drawback in that transferred image defects such as discharge-caused marks, lack of image density, or toner spots may arise during transfer of an image to the back of transfer paper or when the transfer paper is changed in type.

Some of transfer mediums have a greater change in electric resistance ranging over four figures depending upon a change in environmental condition. For example, thick paper containing cotton has usually a surface electrical resistance (i.e., sheet resistivity) of the order of $10^9$ Ω/□ and a volume resistivity of the order of $10^8$ Ω/cm at high temperature and high humidity (e.g., 35° C., 80% RH(Relative Humidity)), but they decrease to $10^{13}$ Ω/□ and $10^{12}$ Ωcm, respectively, at low temperature and low humidity (e.g., 5° C., 10% RH).

The problem of electrical resistance may occur during transfer of an image to the back of the transfer paper. This is because an image is transferred again to the transfer paper which has once passed through the fixing device 107. Specifically, some of transfer mediums require increasing the fixing temperature in order to provide a higher degree of fixing, thereby resulting in a great change in water content of the transfer mediums after the transfer of the image. This causes both the surface electrical resistance and the volume resistivity to increase in a few figures. Specifically, they will be $10^{14}$ Ω/□ and $10^{14}$ Ωcm, respectively, at low temperature and low humidity (e.g., 5° C., 10% RH).

A constant current control system may be used for power supply to the image transferring apparatus. In a case where a change in resistance of the transfer medium is relatively small, the constant current control system is capable of developing the voltage suitable for the image transfer regardless of environmental conditions. A great rise in resistance of the transfer medium due to the change in environmental condition or at the time of the back image transfer will, however, cause the transfer voltage to increase excessively, thereby increasing the possibility of the transferred image defects such as discharge-caused marks, lack of image density, or toner spots.

The transferred image defects are also caused by the compact structure of the device. Usually, the width of the photosensitive drum 101 and the transfer roller 105*a* is designed to be wider than that of a maximum effective width of the transfer mediums in view of a lateral shift of the transfer medium during transportation. This causes, as shown in FIG. 7, the transfer roller 105*a* to be flexed, thereby creating side areas of the transfer roller 105*a* which are in direct contact with the photosensitive drum 101 even when the transfer medium is held. The direct contact side areas have a low apparent resistance. When the transfer medium having a high resistance is transported to a transfer station and held thereat, an excessive current leaks from the transfer roller 105*a* to the photosensitive drum 101 through the direct contact side areas, thus eliminating an excessive rise in transfer voltage, resulting in a decrease in image transfer defect.

However, modern electrophotographic color printers are required to be reduced in size, thus increasing a need for decrease in width of the printers. This causes the width of side areas of the transfer roller 105*a*, as shown in FIG. 8, which are in direct contact with the photosensitive drum 101 to be decreased, thereby resulting in a decrease in leakage of the transfer current to the photosensitive drum 101, which leads to an excessive rise in transfer voltage so that a large number of transferred image defects occur.

In a case where the direct contact side areas of the transfer roller 105*a* are small, a rise in resistance of the transfer medium causes the current flowing through the direct contact side areas to be increased. In this case, the direct contact side areas are reduced in potential, so that fogs are produced on lateral ends of the photosensitive drum 101. A further increase in current flowing through the direct contact side areas causes the current to flow to the face of the transfer medium, thereby decreasing the potential of the photosensitive drum 101, making it difficult to rise the potential of the photosensitive drum 101 to a value required for the next electrifying process. This results in formation of fogs on the lateral ends of the transfer medium, causing print defects to occur.

The above described image defects may be analyzed in detail using an equivalent circuit model of the transfer station shown in FIG. 9. In the following discussion, C1 denotes a capacitance of the photosensitive drum 101 over the width thereof in contact with the transfer medium. C2 denotes a capacitance of the photosensitive drum 101 over the width thereof in direct contact with the transfer roller 105*a*. Rtn denotes an equivalent resistance of a toner image. Rp denotes the resistance of the transfer medium. Rt1 denotes the resistance of the transfer roller 105*a* over the width thereof in contact with the transfer medium. Rt2 denotes the resistance of the transfer roller 105*a* over the width thereof in direct contact with the photosensitive drum 101. It denotes a transfer current provided by a constant power supply. The transfer current It is divided into a current It1 contributing to the image transfer and a current It2 flowing from the direct contact area of the transfer roller 105*a* to the photosensitive drum 101. The relation between It1 and It2 is It1>>It2. Most of the transfer current It flows through the resistor Rt1. Thus, Rt2>>Rt1.

A rise in resistance of the transfer medium caused by a change in ambient condition or the image transfer to the back of the transfer medium is equivalent to a rise in resistance Rp in the equivalent circuit. Because of a rise in resistance of the whole of the circuit, the transfer voltage applied to the toner image resistance Rtn, thereby increasing the possibility of the discharge-caused marks during the image transfer.

The image defects caused by the decrease in width of the printer may be explained using the equivalent circuit of FIG. 9. The resistance Rt2 is increased as compared with the case where the width of the printer is greater, thus decreasing the current It2. This causes the current It1 to increase to increase the voltage applied to the toner image resistance Rtn, thereby increasing the possibility of the discharge-caused marks during the image transfer.

In the printer whose width is smaller (i.e., Rt2 is smaller), an increase in resistance Rp of the transfer medium causes the current It2 flowing directly to the photosensitive drum 101 to increase by a decreased amount of the current It1, thereby resulting in a decrease in potential at contact side areas of the photosensitive drum 101 and the transfer roller 105*a*, so that fogs are formed on the lateral ends of the photosensitive drum 101. A further increase in current will cause the current to flow through the photosensitive drum 101 toward the face of the transfer medium, thereby resulting in the formation of the fogs on the lateral ends of the transfer medium.

The conventional printers use a temperature/humidity sensor to control the transfer current for absorbing a variation in resistance of the transfer medium. This, however, results in complexity of the structure and increase in production costs.

In order to avoid the above problems, Japanese Patent First Publication No. 10-207258 proposes a bypass circuit connected directly to ground. This structure, however, causes most of the transfer current to flow to the bypass circuit, which impinges upon the transfer of images.

SUMMARY OF THE INVENTION

It is therefore a principal object of the present invention to avoid the disadvantages of the prior art.

It is another object of the present invention to provide a recording apparatus designed to have a compact structure without producing a variation in resistance of a transfer medium caused by a change in ambient condition or the image transfer to the back of the transfer medium and forming any transferred image defects.

According to one aspect of the invention, there is provided a recording apparatus which comprises: (a) an image carrier; (b) a transfer member disposed in contact with the image carrier to hold a transported transfer medium therebetween, a constant current being applied to the transfer member to transfer visible images formed on the image carrier to the transfer medium; and (c) a bypass circuit having a given resistance. The bypass circuit is connected to portions of the transfer member which are in contact with the image carrier and located outside a range of passage of the transfer medium to cause the constant current supplied to the transfer member to flow partially to the bypass circuit, thereby avoiding formation of any print defects such as discharge-caused marks and developer spots on the transfer medium. The activities of the resistor serve to suppress excessive flow of the current to the bypass circuit.

According to another aspect of the invention, there is provided a recording apparatus which comprises: (a) an image carrier; (b) a transfer member disposed in contact with the image carrier to hold a transported transfer medium therebetween, a constant current being applied to the transfer member to transfer visible images formed on the image carrier to the transfer medium; and (c) a conductive member disposed in contact with a surface of the transfer member. The conductive member is connected to ground through a resistor.

In the preferred mode of the invention, a current equivalent to an amount of current leaking to the resistor from the conductive member is added to the constant current applied to the transfer member.

The conductive member is located outside a range of passage of the transfer medium through a nip between the image carrier and the transfer member.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
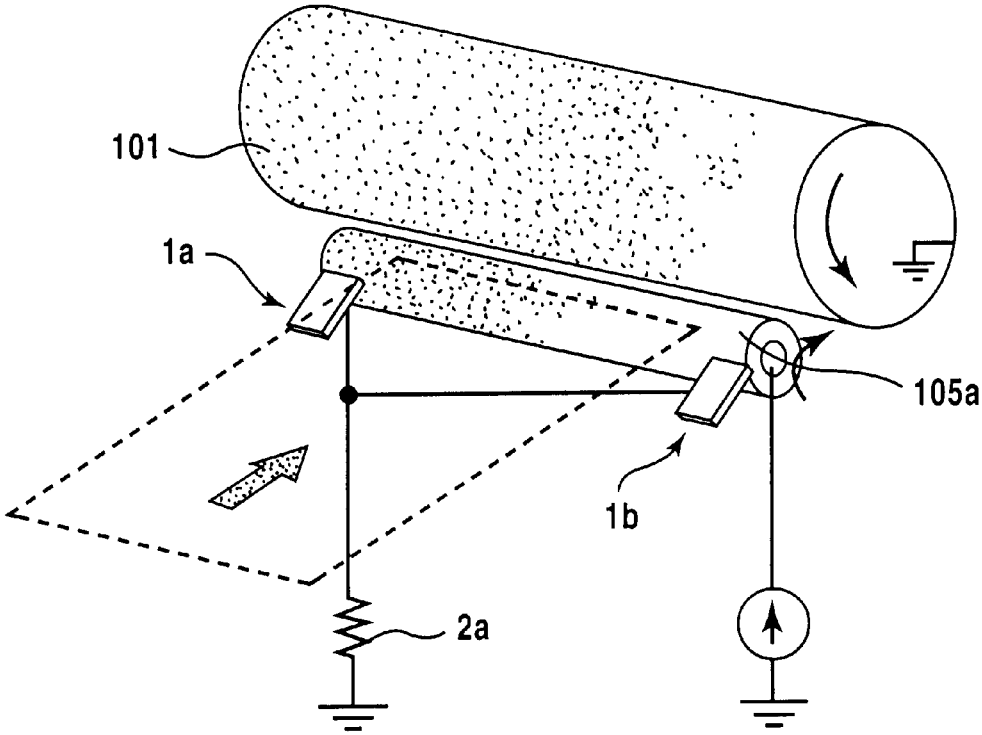
FIG. 1 is a perspective view which shows the structure of an image transferring station according to the present invention.
Figure 2:
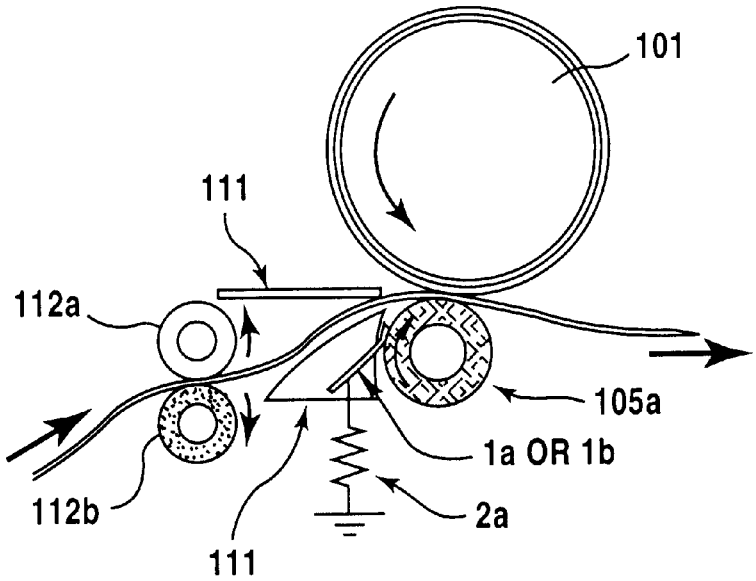
FIG. 2 is a partially sectional side view of FIG. 1.

Referring now to the drawings, wherein like numbers refer to like parts in several views, particularly to FIGS. 1 and 2, there is shown a transfer mechanism according to the first embodiment of the invention which is used with, as one example, a laser printer.

Figure 6:
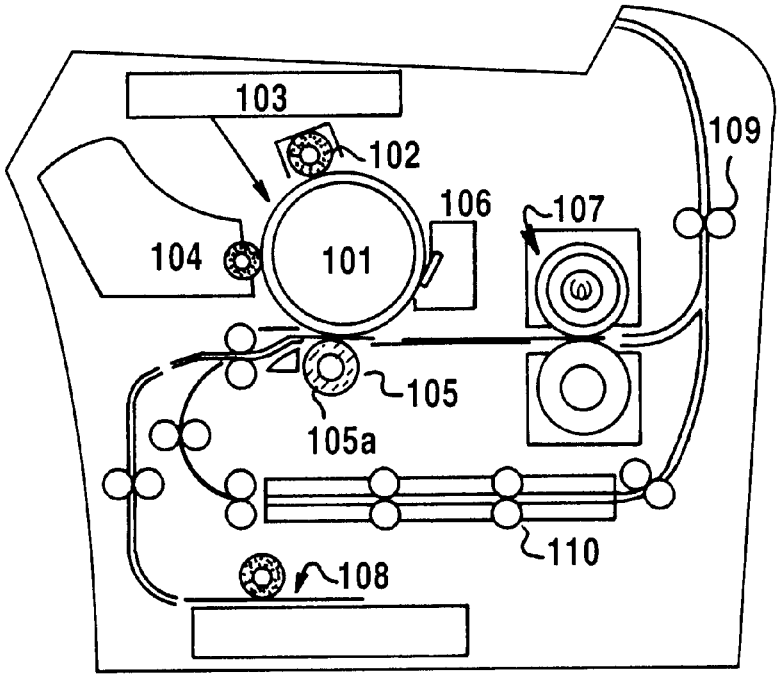
FIG.6 PRIOR ART
FIG. 6 is a sectional view which shows a conventional printer.

The conductive brushes 1*a* and 1*b* are provided in contact with end surfaces of the transfer roller 105*a*. The conductive brushes 1*a* and 1*b* each have a width of 10 mm and are attached to surfaces of an ABS-made transfer guide 111 facing the transfer roller 105*a*. The transfer guide 111 is provided for transportation guide before an image transferring operation. The transfer roller 105*a* and the photosensitive drum 101 are the same as those shown in FIGS. 6 to 8, and explanation thereof in detail will be omitted here.

The conductive brushes 1*a* and 1*b* have conductive bases connected to ground through the resistor 2*a* to form a transfer current bypass circuit. The resistance value of the resistor 2*a* is 300 Ω, for example.

Figure 7:
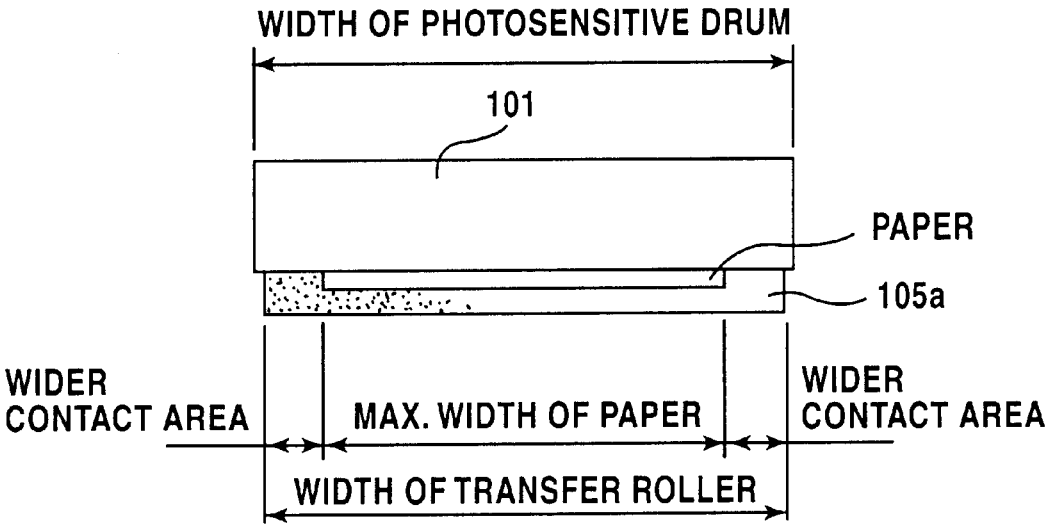
FIG. 7 PRIOR ART
FIG. 7 is a view which shows a conventional structure in which an area of contact of the photosensitive drum 101 with the transfer roller 105*a* is wider.
Figure 8:
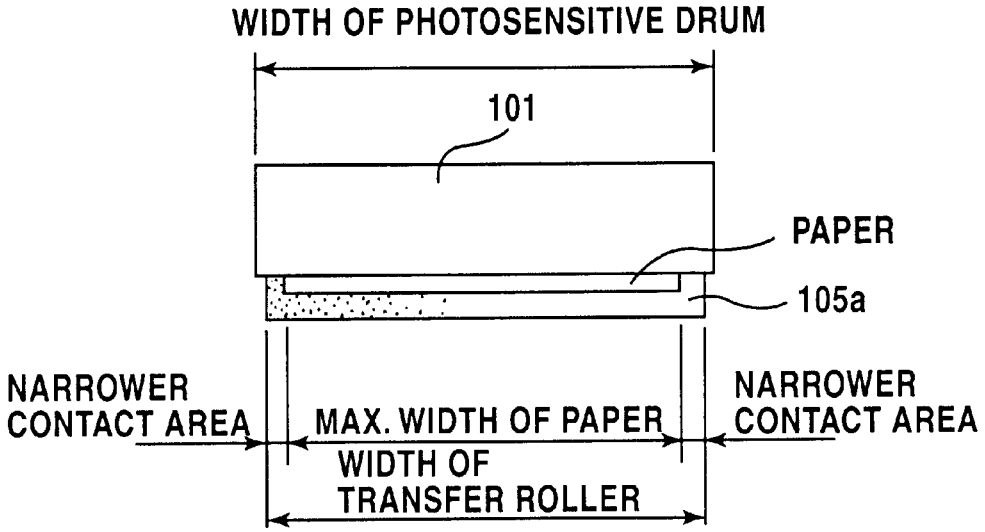
FIG. 8 PRIOR ART
FIG. 8 is a view which shows a conventional structure in which an area of contact of the photosensitive drum 101 with the transfer roller 105*a* is narrower.

A thick bond print sheet which always has any print defects in the conventional printer, as shown in FIGS. 7 and 8, is used to print images on both surfaces thereof in a lower temperature and lower humidity condition (5° C., 10% RH). The conventional printer uses a higher transfer voltage as much as 2.0 to 2.2 kV in the back image transfer, so that the discharge-caused marks are formed over the entire surface of the print sheet. The structure of this embodiment allows the transfer voltage used in the back image transfer to be decreased to 1.5 to 1.7 kV, thereby avoiding the formation of the discharged-caused marks and the toner spots on the print sheet.

Figure 3:
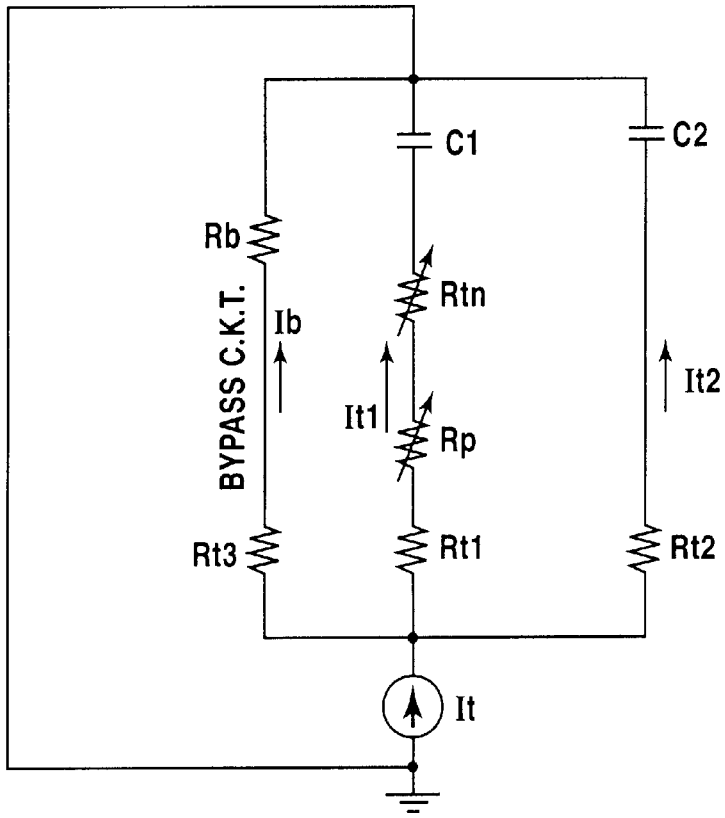
FIG. 3 is a diagram which shows an equivalent circuit of the structure shown in FIG. 1.
Figure 9:
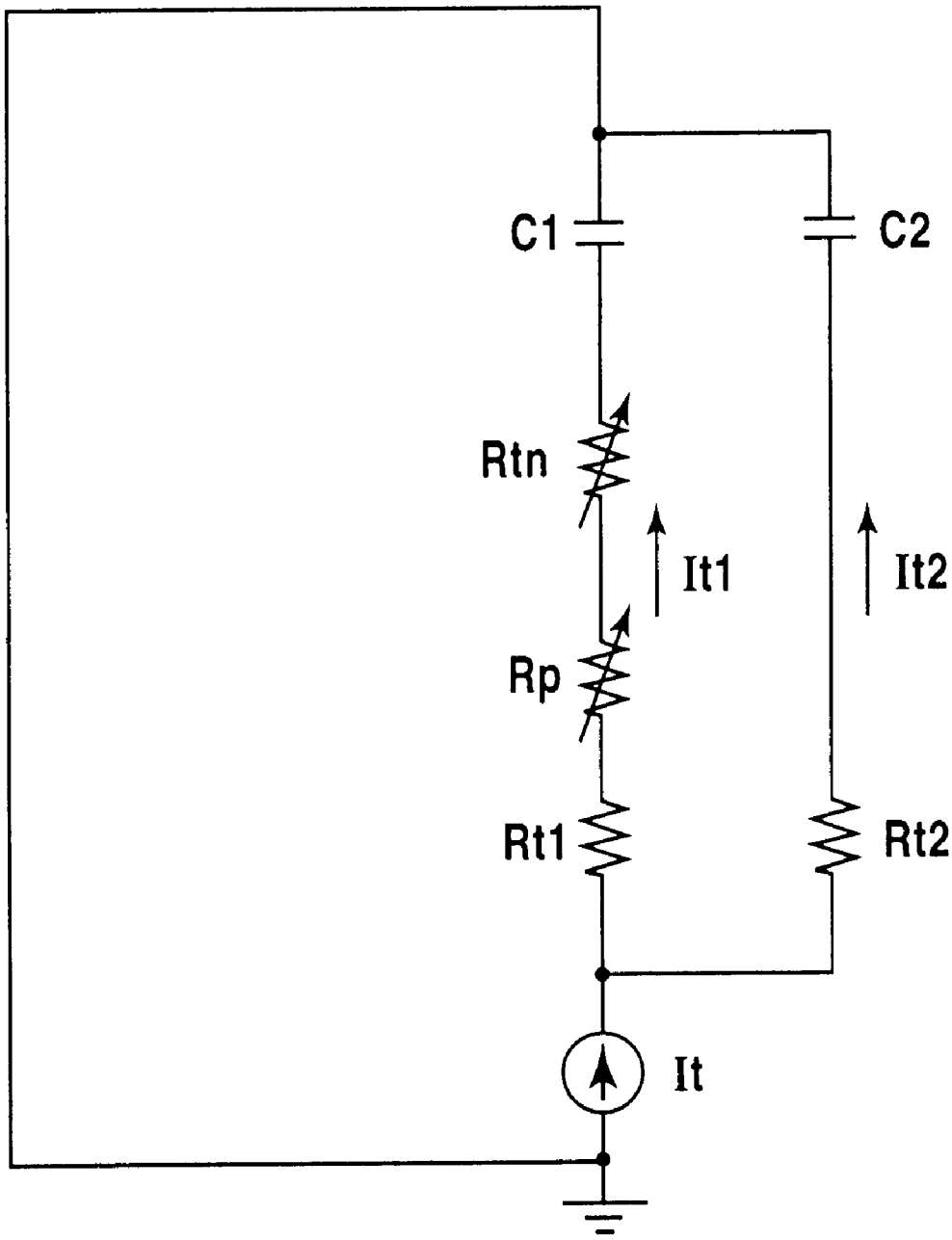
FIG. 9 is a diagram which shows an equivalent circuit of the structure of a conventional printer.

FIG. 3 shows an equivalent circuit of the structure of this embodiment which is different from the one shown in FIG. 9 in addition of a bypass circuit. The bypass circuit has the bypass resistance Rb and the resistance Rt3 provided by width-wise portions of the surface of the transfer roller 105*a* in contact with the conductive brushes 1*a* and 1*b*.

An increased resistance of the transfer medium or print sheet which causes the above described print defects is equivalent to a rise in resistance Rp. This resistance rise will cause the current Ib flowing to the bypass circuit to increase, thus resulting in a decrease in current It1 contributing to the image transferring operation. This causes the voltage applied to the toner image resistance Rtn to drop, thereby avoiding the formation of the discharge-caused marks resulting from an excessive rise in transfer voltage.

The current corresponding to a decreased amount of the current It1 is divided into the currents It2 and 1*b*, thereby avoiding a drop in potential of the direct contact area of the photosensitive drum 101 and the transfer roller 105*a* and decreasing the amount of the current It2 flowing toward the surface of the print sheet, so that images are produced without any fogs on ends of the print sheet.

In the range from a normal ambient condition of 20° C. and 50% RH to a high temperature/high humidity ambient condition of 35° C. and 80% RH, the resistance Rp of the transfer medium is relatively low even after the fixing operation and smaller than or equal to the bypass resistance Rb, thus resulting in a decrease in current flowing to the bypass circuit, so that a sufficient amount of current can be used in transferring toner images.

The second embodiment of the invention will be described below.

Figure 4:
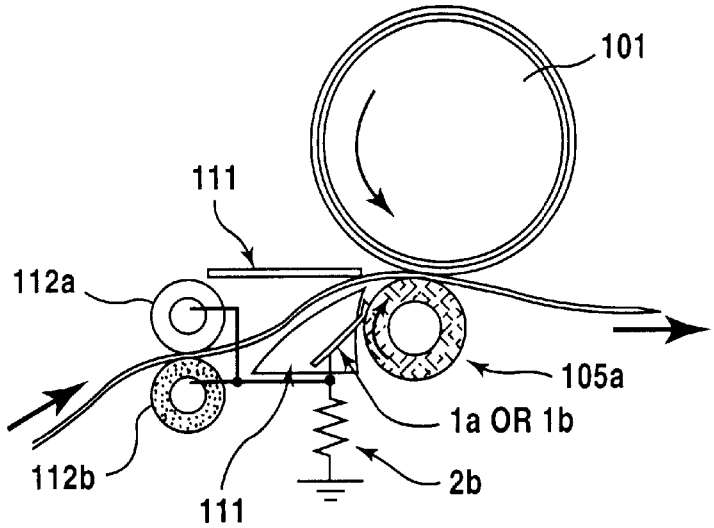
FIG. 4 is a partially sectional view which shows the structure of an image transferring station according to the second embodiment of the invention.

Usually, in order to avoid leakage of the transfer current to the resist rollers 112*a* and 112*b* serving to adjust the timing of transportation of print sheets to the transfer nip, the resist rollers 112*a* and 112*b* are connected to ground through a resistor. The resistor has usually 100 to 500M Ω and thus may also be used as the resistor 2*a* of the bypass circuit. Such a structure is shown in FIG. 4. The shown structure uses only one resistor and is thus simple.

Specifically, the resistor roller resistor 2*b* having 300M Ω is connected to the conductive brushes 1*a* and 1*b*. Like the first embodiment, the second embodiment can print images without any print defects such as the discharge-caused marks and toner spots even on the back of the print sheet in low temperature/low humidity ambient conditions.

The third embodiment will be described below.

In the structure of the second embodiment in a low temperature and low humidity ambient condition of 5° C. and 10% RH, currents of 1.6 to 1.9 μA and 2.6 to 3.1 μA flow to the bypass circuit during the face image transferring operation and the back image transferring operation, respectively. Images are printed on the transfer medium without the discharge-caused marks and toner spots, however the print density is lower than normal. For instance, the OD (Optical Density) of printed images is decreased from 1.3 to 1.2.

In order to compensate for an amount of the transfer current flowing to the bypass circuit, tests were performed to add a compensating current to the transfer current. Table 1 below shows the results of the tests.

TABLE 1

| Resolution:600dpi | face | back |
|---|---|---|
| Thick bond paper | | |
| conventional printer | ▲ several discharge-caused marks | X many discharge-caused marks |
| printer with bypass circuit no compensating current | ○ | Δ reduction in density : OD = 1.2 |
| printer with bypass circuit compensating current of 1.5 μA | ○ | ○ good density: OD = 1.3 or more |
| printer with bypass circuit compensating current of 2.0 μA | ○ | ○ good density: OD = 1.3 or more |
| printer with bypass circuit compensating current of 3.0 μA | Δ a few discharge-caused marks | Δ a few discharge-caused marks |
| Standard paper | | |
| conventional printer | Δ a few discharge-caused marks | X many discharge-caused marks |
| printer with bypass circuit no compensating current is added | ○ | ○ |
| printer with bypass circuit compensating current of 1.5 μA | ○ | ○ |
| printer with bypass circuit compensating current of 2.0 μA | ○ | ○ |
| printer with bypass circuit compensating current of 3.0 μA | ○ | Δ a few discharge-caused marks |

The test results show that even if the compensating current is increased to 3 μA greatly, the transfer current partially flows to the bypass circuit, thereby avoiding an excessive increase in transfer current, but a compensating current of 3 μA will cause a few discharge-caused marks to be formed. It is, thus, appreciated that addition of currents of 1.5 μA and 2.0 μA as the compensating current to a normal transfer current of 6 μA to provide total currents of 7.5 μA and 8 μA in the face and back image transferring operations, respectively, causes the OD of images printed on the back of the print sheet to be increased to 1.3, resulting in improved quality of the printed images without the discharge-caused marks and toner spots.

Figure 5:
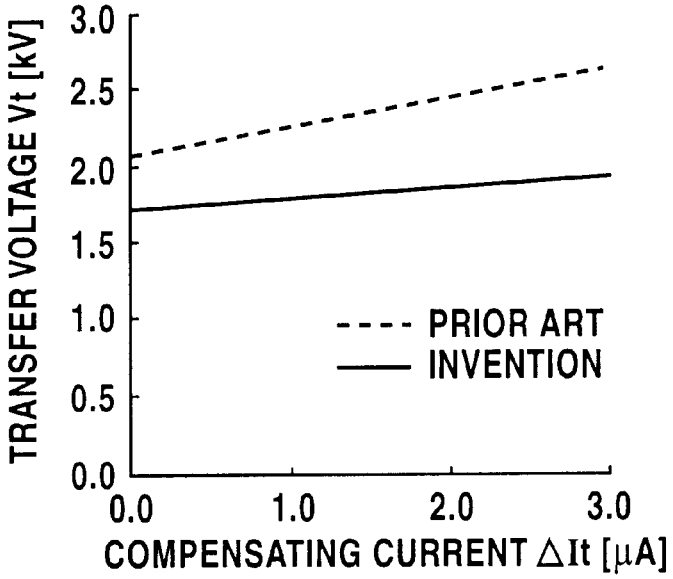
FIG. 5 is a graph which shows changes in transfer voltage when a compensating current is increased in a conventional printer and the structure of the third embodiment.

FIG. 5 is a graph which shows changes in transfer voltage when the compensating current is increased in a conventional printer and the structure of the third embodiment provided with the bypass circuit. It is found that the bypass circuit in the third embodiment serves to minimize an increase in transfer voltage even when the compensating current is added.

The fourth embodiment will be described below.

The second embodiment refers to an electrophotographic color printer whose resolution is 600 dpi. An increase in resolution in a direction of transportation of the print sheet up to 12000 dpi may be achieved by decreasing the speed of the photosensitive drum 101 to 36 mm/s which is half that in a normal print mode. In this case, the current Ib flowing through the bypass circuit is 1.5 to 1.6 μA during the face image transferring operation and 2.2 to 2.6 μA during the back image transferring operation, which are substantially identical with those in the case of the normal resolution. The results of printing for different values of the compensating current are listed in Table 2 below. The compensating currents of 1.5 μA and 2 μA used in the face image transferring operation and the back image transferring operation, respectively, are the same as those used in the case of the normal resolution. It is found that a decreased density of images caused by the bypass circuit is, like the third embodiment, compensated for so that the OD is increased from 1.2 to 1.3, thereby resulting in improved quality of images without the discharge-caused marks and the toner spots.

TABLE 2

| Resolution: 1200dpi | face | back |
|---|---|---|
| Thick bond paper | | |
| conventional printer | ▲ several discharge-caused marks | X many discharge-caused marks |
| printer with bypass circuit no compensating current | ○ | Δ reduction in density : OD = 1.2 |
| printer with bypass circuit compensating current of 1.5 μA | ○ | ○ good density: OD = 1.3 or more |
| printer with bypass circuit compensating current of 2.0 μA | ○ | ○ good density: OD = 1.3 or more |
| printer with bypass circuit compensating current of 3.0 μA | Δ a few discharge-caused marks | Δ a few discharge-caused marks |
| Standard paper | | |
| conventional printer | Δ a few discharge-caused marks | X many discharge-caused marks |
| printer with bypass circuit no compensating current is added | ○ | ○ |
| printer with bypass circuit compensating current of 1.5 μA | ○ | ○ |
| printer with bypass circuit compensating current of 2.0 μA | ○ | ○ |

TABLE 2-continued

| Resolution: 1200dpi | | |
|---|---|---|
| | face | back |
| printer with bypass circuit compensating current of 3.0 μA | ○ | Δ a few discharge-caused marks |

The fifth embodiment will be described below.

In the first to fourth embodiments, the conductive brushes 1*a* and 1*b* are disposed outside a width of the transfer roller 105*a* through which the print sheet passes. Specifically, the conductive brushes 1*a* and 1*b* are located near side edges of the print sheet, thereby eliminating the need for consideration of the resistance of the surface of the transfer roller 105*a*. This enables the transfer current which flows round the side edges of the print sheet in the conventional printer to be introduced into the conductive brushes 1*a* and 1*b* effectively, thus reducing a drop of surface potential so that images can be printed without any fogs on the edge portions of the print sheet.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

For example, the values of the transfer current, the bypass resistance, and the compensating current may be determined as a function of the material and mechanical properties of the photosensitive drum 101, the toner, and the transfer medium, the potential conditions, the fixing temperature, or the processing speed.

The conductive brushes 1*a* and 1*b* may be installed inside a width of the transfer roller 105 through which the print sheet passes as long as they are located outside a print-inhibit area of the print sheet.

The above embodiments refer to a reversal processing system in which toner having negative charges are applied on a negatively electrified photosensitive member, but the present invention may be used with a process where the sign is reversed or a positive processing system.

What is claimed is:

1. A recording apparatus comprising:

an image carrier;

a transfer member disposed in contact with said image carrier to hold a transported transfer medium therebetween, a constant current being applied to the transfer member to transfer visible images formed on said image carrier to the transfer medium; and a bypass circuit having a given resistance, said bypass circuit being connected to portions of said transfer member which are in contact with said image carrier and located outside a range of passage of the transfer medium to cause the constant current applied to said transfer member to flow partially to said bypass circuit.

2. A recording apparatus comprising:

an image carrier;

a transfer roller disposed in contact with said image carrier to hold a transported transfer medium therebetween, a constant current being applied to the transfer roller to transfer visible images formed on said image carrier to the transfer medium; and a conductive member disposed in contact with a surface of said transfer roller, said conductive member being connected to ground through a resistor.

3. A recording apparatus comprising:

an image carrier;

a transfer member disposed in contact with said image carrier to hold a transported transfer medium therebetween, a constant current being applied to the transfer member to transfer visible images formed on said image carrier to the transfer medium; and a conductive member disposed in contact with a surface of said transfer member, said conductive member being connected to ground through a resistor, wherein a current equivalent to an amount of current leaking to the resistor from said conductive member is added to the constant current applied to said transfer member.

4. A recording apparatus comprising:

an image carrier;

a transfer member disposed in contact with said image carrier to hold a transported transfer medium therebetween, a constant current being applied to the transfer member to transfer visible images formed on said image carrier to the transfer medium; and a conductive member disposed in contact with a surface of said transfer member, said conductive member being connected to ground through a resistor, wherein said conductive member is located outside a range of passage of the transfer medium through a nip between said image carrier and said transfer member.

5. A recording apparatus comprising:

an image carrier;

a transfer roller disposed in contact with said image carrier to hold a transported transfer medium therebetween, a constant current being applied to the transfer roller to transfer visible images formed on said image carrier to the transfer medium; and a conductive brush disposed in contact with a surface of said transfer roller, said conductive brush being connected to ground through a resistor.

* * * * *